US008561778B2

(12) United States Patent
Kieran

(10) Patent No.: US 8,561,778 B2
(45) Date of Patent: Oct. 22, 2013

(54) CAP-LINING MACHINE FEED ASSEMBLY AND METHOD

(76) Inventor: Thomas G. Kieran, Peoria, AZ (US)

( * ) Notice: Subject to any disclaimer, the term of this patent is extended or adjusted under 35 U.S.C. 154(b) by 0 days.

(21) Appl. No.: 13/404,668

(22) Filed: Feb. 24, 2012

(65) Prior Publication Data

US 2013/0220768 A1 Aug. 29, 2013

(51) Int. Cl.
*B65G 43/00* (2006.01)

(52) U.S. Cl.
USPC ..... 198/301; 156/355

(58) Field of Classification Search
USPC ..... 198/341.03, 341.01
See application file for complete search history.

(56) References Cited

U.S. PATENT DOCUMENTS

| | | | | |
|---|---|---|---|---|
| 1,540,009 | A | 6/1925 | Hothersall | |
| 1,628,338 | A | 5/1927 | Skov | |
| 2,017,124 | A | 10/1935 | Johnson | |
| 2,471,255 | A | 5/1949 | Weisenburg | |
| 2,567,141 | A | 9/1951 | Andrew | |
| 2,912,042 | A | 11/1959 | Jenkins | |
| 3,782,525 | A * | 1/1974 | Flury | 198/530 |
| 4,295,436 | A | 10/1981 | Zangari et al. | |
| 4,568,406 | A * | 2/1986 | Kieran et al. | 156/355 |
| 4,728,239 | A | 3/1988 | Kieran et al. | |
| 5,108,356 | A | 4/1992 | Rickenbach et al. | |
| 6,405,448 | B1 * | 6/2002 | Watkins | 33/645 |

* cited by examiner

*Primary Examiner* — Gene Crawford
*Assistant Examiner* — Lester Rushin
(74) *Attorney, Agent, or Firm* — Thomas W. Galvani, P.C.; Thomas W. Galvani

(57) ABSTRACT

An assembly for moving caps through a cap-lining machine includes a track for the downstream movement of the caps to a cap-lining location in the cap-lining machine. A first gate is mounted downstream from the cap-lining location for movement between first and second positions preventing and allowing downstream movement of the caps, respectively. A sensing location is formed in the track downstream from the cap-lining location. A second gate is mounted downstream from the sensing location for movement between first and second positions preventing and allowing downstream movement of the caps, respectively. The first gate moves to the first position in response to a sensor sensing the arrival of one of the caps at the sensing location, and the second gate moves to the second position in response to the first gate moving to the first position.

20 Claims, 5 Drawing Sheets

CAP-LINING MACHINE FEED ASSEMBLY AND METHOD

FIELD OF THE INVENTION

The present invention relates generally to cap-lining machines and more particularly to methods and assemblies for feeding caps through cap-lining machines.

BACKGROUND OF THE INVENTION

Container closures or caps are generally lined with a thin metal foil or paper liner before assembly onto the container. There are many types of machines for applying the liners to the caps. Most operate by feeding a cap into a cap-lining mechanism where a paper insert is punched from a web of liner paper and then tamped into the cap. Most machines line an extraordinary quantity of caps at an incredible rate. The machines often fail, however, creating downtime that can result in production and supply issues.

In many past cap-lining machines, the caps were mechanically fed into the cap-lining machine, such as by a stuffer rod which pushed a set of caps into a channel toward the machine. A line of caps thus moved through the channel, the stuffer rod pushing the line forward and sequentially adding an incoming set of caps at the upstream end while downstream caps moved off the line and into the cap-lining mechanism. These stuffer rods were frequently used in tracks which included a right-angle bend, and were limited in that the stuffer rods could only advance a set of caps when the caps were fed to the stuffer rods; the speed with which the stuffer rod could push caps down the track was inversely proportional to the number of caps to be fed to the stuffer rod. Beyond these inefficiencies, there were a number of ways that past cap-lining machines failed. For instance, if the supply of caps to the cap-lining mechanism ceased, the cap-lining mechanism would still continue to punch and tamp—and thus waste—liner inserts. If it was successfully detected, a problem such as this required shutting down the entire machine, fixing the cap supply problem, removing jammed liner inserts, resetting the paper liner feed, and restarting the machine, resulting in considerable lost time and production. Numerous attempts at solving the liner paper waste problem were made, most focusing on stopping the feeding of the liner paper when the cap supply ceased.

New cap construction techniques, however, render many of these past machines undesirable. Cap manufacturers are using increasingly softer and lighter materials to create thinner, more pliable caps. When such caps are advanced through a narrow channel, as by the stuffer rod, they frequently deform and bind within the channel. The caps may be permanently deformed, in which case the liner inserts cannot be properly applied to the caps, or the caps may actually crack, in which case the liner insert can be applied but will not form a heat seal when the cap is assembled on the closure. When a cap binds within the channel, the downstream caps fail to advance, and the upstream caps become jammed, deformed, and broken as more caps are stuffed down the channel by the stuffer rod. While the cap-lining machine may detect that a new cap has not been presented to the cap-lining mechanism, upstream caps may continue to be damaged, and a worker must shut the machine down, remove the bound cap, inspect the machine for damage, inspect and remove the damaged caps from the system, and restart the machine.

The new construction of caps presents problems for holding the caps in position in preparation for lining as well. In the past, caps were placed under the punch or tamper and held in alignment with the tamper by a biased or sprung mechanism acting on the cap from one or several sides. After the cap had been lined, the cap would be advanced from the biased mechanism. The caps frequently squeezed out of the biased mechanism at high speeds, which could cause the caps to fly out of the machine, move too quickly for downstream daisy-chained operations, or jam in the downstream channel. Further, the biased mechanism could deform or even crush the cap while it was being held in place for lining. This would result in an improperly-fit liner insert, caps moved out of alignment from the punch, smashed caps, jammed lining locations, and other problems which caused mechanical damage to the cap-lining machine and could require the cap-lining machine to be shut down and repaired.

The past machines were also dangerous to users. Most of the mechanical assemblies that would stop the feed of the liner paper when a cap was missing used heavy, complex, moving parts. Machines that mechanically moved caps into place, such as by large rotating tables, cam-driven racks, or stuffer rods, usually employed heavy, rugged, metal fixtures. The stuffer rods, for instance, were frequently driven by clutched gear assemblies capable of producing a large amount of torque and force to push a long line of caps toward and through a cap-lining machine. Moving parts such as these presented safety hazards to errant fingers and limbs.

SUMMARY OF THE INVENTION

In accordance with the principles of the invention, an assembly for moving caps through a cap-lining machine includes a track for the downstream movement of the caps from an upstream end of the track to a cap-lining location at the opposed downstream end of the track. A first gate is mounted downstream from the cap-lining location for movement between first and second positions allowing and preventing, respectively, the downstream movement of the caps past the cap-lining location. A sensing location is also formed in the track downstream from the cap-lining location, and a second gate is mounted downstream from the sensing location for movement between first and second positions allowing and preventing, respectively, the downstream movement of the caps past the sensing location. The assembly includes a sensor for sensing the arrival of a cap at the sensing location. In operation, a first cap moves downstream until it encounters the first gate in the first position. The first gate cooperates with the caps to position the first cap at the cap-lining location in preparation for lining. The cap-lining machine lines the cap, the first gate moves to the second position, and the first cap is allowed to move downstream until it encounters the second gate in the first position. The second gate cooperates with the caps to position the first cap at the sensing location in preparation for sensing. In response to the sensor sensing the first cap at the sensing location, the first gate moves to the first position, and the second gate moves to the second position, allowing the first cap to leave the sensing location and the second cap to move into the cap-lining location.

BRIEF DESCRIPTION OF THE DRAWINGS

Referring to the drawings.

DETAILED DESCRIPTION

Figure 1:
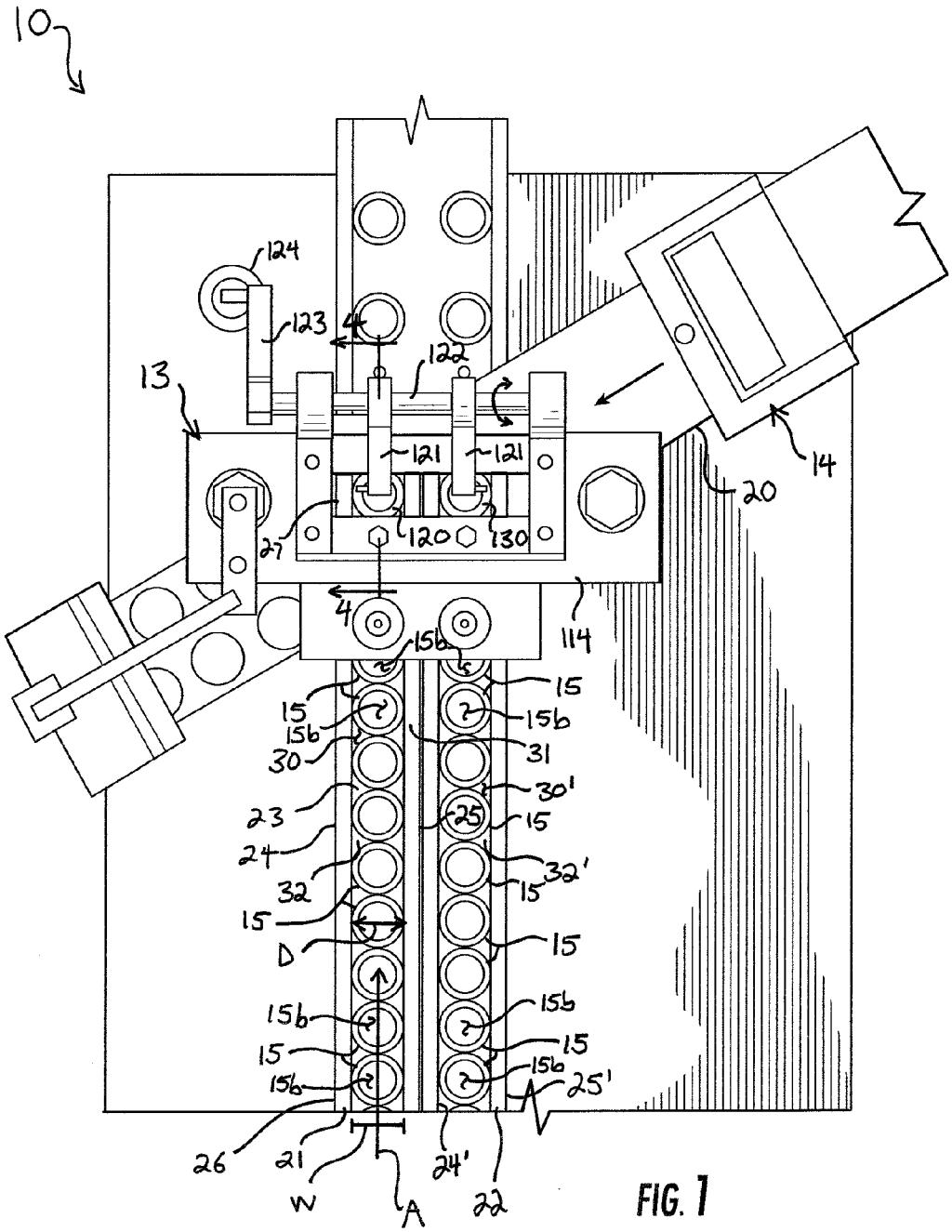
FIG. 1 is a partially cut-away top view of a cap-lining machine constructed and arranged in accordance with the principle of the invention, including a track assembly, a cap-lining mechanism, a liner paper feeder, and caps loaded into the track assembly.

Reference now is made to the drawings, in which the same reference numbers are used throughout the different figures to designate the same components. FIG. 1 shows a cap-lining machine 10 useful for lining container closures or caps 15 with liner paper. Cap-lining machine 10 is mounted on a solid, stable table 11 and includes a track assembly 12, a cap-lining mechanism 13, and a liner paper feeder 14. Caps 15 are supplied from a supply bin (not shown) onto the track assembly 12 and move down the track assembly 12 toward the cap-lining mechanism 13 in the direction indicated by line A on FIG. 1. The liner paper feeder 14 feeds a web of liner paper 20 to the cap-lining mechanism 13, and the cap-lining mechanism 13 punches liner inserts from the liner paper 20 and tamps the liner inserts into the caps 15, which then exit the cap-lining mechanism 13 in an assembled condition.

In the embodiment shown in FIG. 1, the caps 15 are fed, two at a time, into the cap-lining mechanism 13 on tracks 21 and 22 in track assembly 12. The track assembly 12 is a linear feed into the cap-lining mechanism 13, allowing caps to be continually moved downstream into the cap-lining mechanism 13 to maintain a short operational cycle time of the cap-lining mechanism 13. Cap-lining mechanism 13 may be modified to punch and tamp liner inserts into one, two, three, or many caps at once by modifying the number of tracks in track assembly 12 without affecting the operational cycle time of the cap-lining mechanism 13. For instance, a track assembly might have eleven separate tracks for feeding rows of eleven caps into the cap-lining mechanism simultaneously. The cap-lining mechanism would have eleven stations punching and tamping liner inserts into the rows of eleven caps. In the embodiment shown in FIG. 1, however, the cap-lining mechanism 13 is arranged to line two caps 15 at once. Discussion will thus be with respect to the two track arrangement, with the understanding that that the discussion applies equally to cap-lining machines according to the principle of the invention employing a different number of tracks. The tracks 21 and 22 are identical in every respect to each other except in location and as described herein, and as such, the discussion will refer only to the track denoted with the reference character 21, with the understanding that the discussion applies equally to track 22, and throughout the figures, reference characters used to describe the various structural features of track 21 are applied to track 22 but are designated with a prime ("") so as to distinguish those structural features from the structural features of track 21.

Figure 3A:
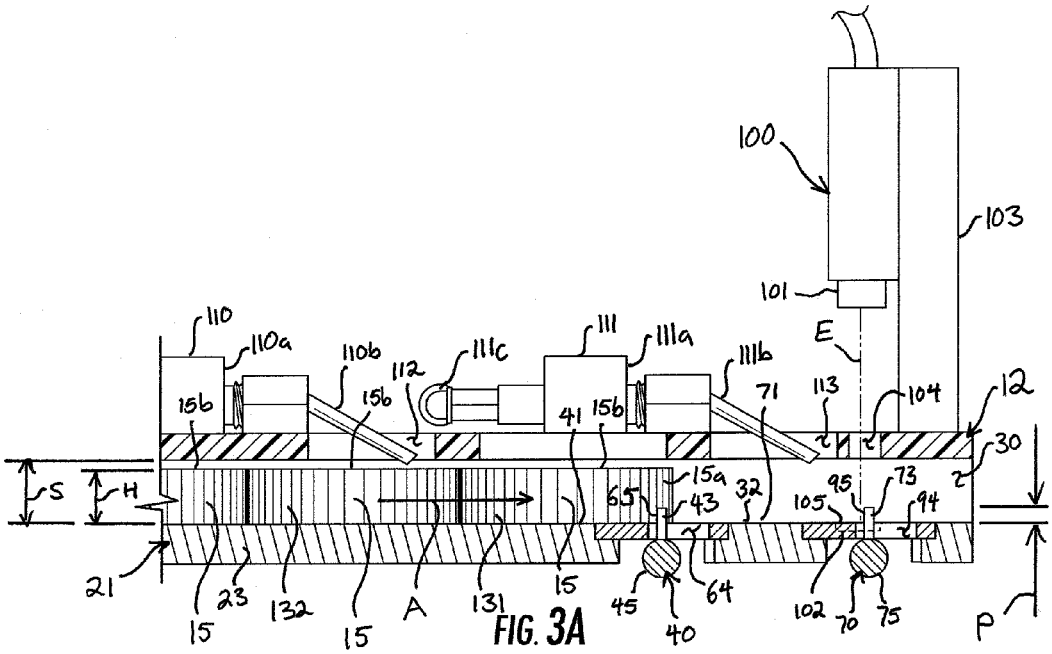
FIGS. 3A-3E are section views of the track assembly taken along the line 3-3 in FIG. 2, showing a sequence of operational steps of the track assembly of FIG. 1 with corresponding movement of the caps through the track assembly.

Track 21 is straight and includes a base 23 and opposed upstanding sidewalls 24 and 25 which extend linearly between an upstream end 26 and a downstream end 27 of the track 21. The base 23 and sidewalls 24 and 25 cooperate to define an elongate channel 30 in the track 21 through which the caps 15 move downstream along a path from the upstream end 26 to the downstream end 27. The caps 15, including the first and second caps 131 and 132, each have an outer sidewall 15*a* extending between an open bottom 15*b* and a closed top 15*c*. The channel 30 has a width W which is only slightly greater than an outer diameter D of the caps 15. Because width W is only slightly greater than the outer diameter D, as the caps 15 move downstream along the path through the channel 30, lateral movement of the caps 15 within the channel 30 is limited by interaction of the caps 15 with the sidewalls 24 and 25. The track 21 is fitted with a transparent cover 31, more easily seen in FIG. 3A, that extends across the track 21 between the sidewalls 24 and 25 along the full length of track from the upstream end 26 to proximate to the downstream end 27. The cover 31 is releasably fastened to the track 21 with screws, bolts, or like fasteners, so that the cover 31 can be removed if the track 21 requires repair or maintenance. As seen in FIG. 3A, the cover 31 is secured on top of the track 21 and is spaced above and apart from the base 23 of the track 21 by a distance S, which is only slightly greater than a height H of the caps 15. For example, the height H of each of the caps 15 is approximately 0.450 inches, and the distance S by which the cover 31, applied to the sidewalls 24 and 25, is spaced apart from the base 23 on which the caps 15 rest, approximately 0.500 inches, providing a gap of approximately 0.050 inches between the open bottoms 15*b* of the caps 15 (which are directed upwards) and the cover 31.

Returning to FIG. 1, the caps 15 move in the track 21 downstream toward the cap-lining mechanism 13 in preparation for lining. The caps 15 are fed by a gravity feed or a light-action belt conveyor (not shown) onto the track 21 from the supply bin (not shown). The base 23 of the track 21 has a sliding surface 32 with a low coefficient of friction. Constructed with this material characteristic, the base 23 allows the caps 15 to slide downstream on their tops 15*c* with low frictional resistance with respect to the surface 32. Base 23 is preferably constructed out of a polished metal, but may be constructed out of other materials or combination of materials having low-coefficient of frictions, such as plastic. Alternatively, the surface 32 may be polished or sprayed with an anti-friction coating, such as polytetrafluoroethylene.

Figure 2:
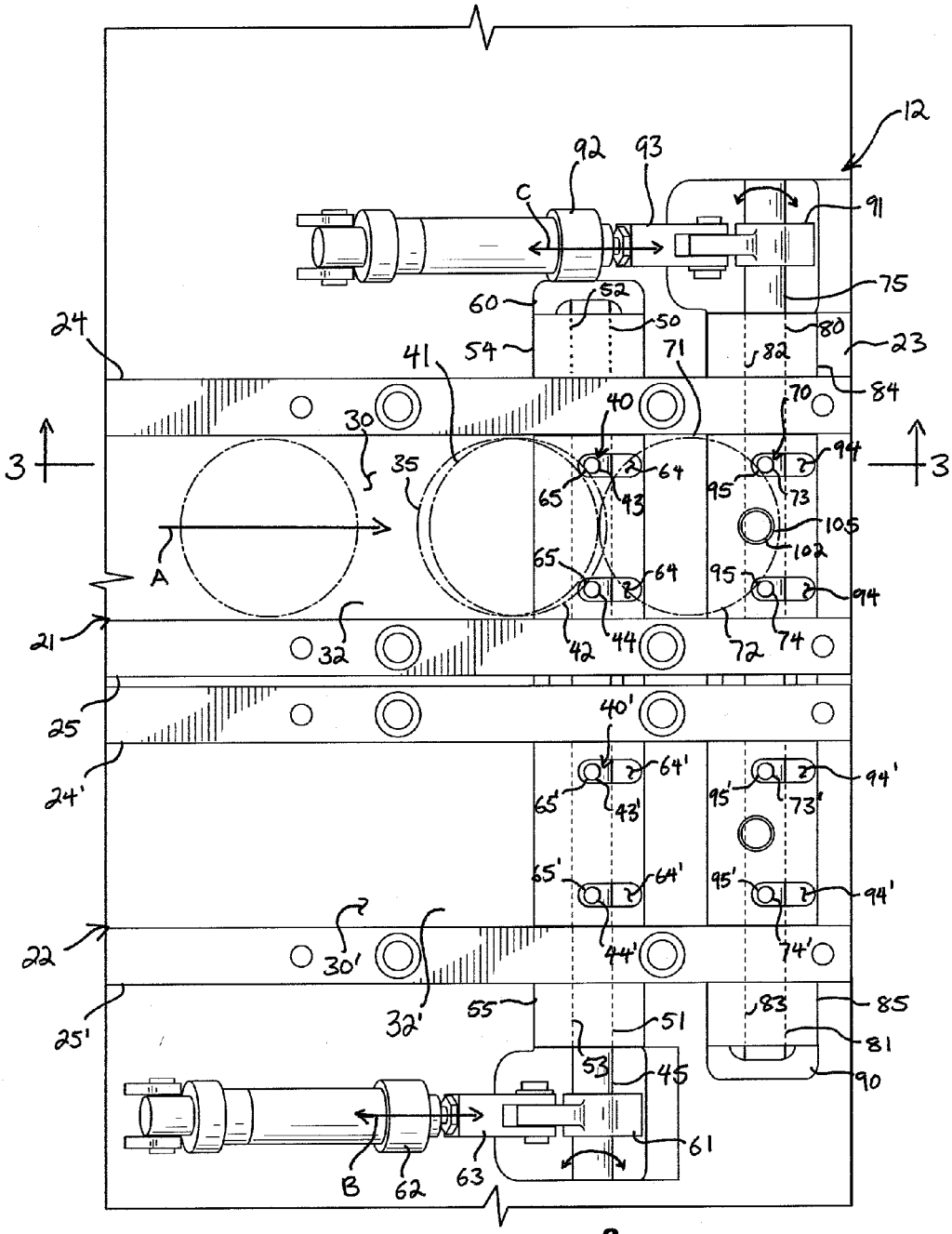
FIG. 2 is a partially cut-away top view of a portion of the track assembly of FIG. 1 located under the cap-lining mechanism.

With continuing reference to FIG. 1, the downstream end 27 of the track 21 is positioned under the cap-lining mechanism 13. Looking briefly to FIG. 4B, the cap-lining mechanism 13 includes a punch 33 and a tamper 34 for punching a liner insert 35 from the web of liner paper 20 and tamping and lining the liner insert 35 into a cap 15 positioned under the tamper 34. An upstream or first gate assembly 40 temporarily interrupts and prevents the downstream movement of the cap 15 through the track 21 to hold the cap 15 in position for lining. Referring now to FIG. 2, which illustrates a top plan view of a portion of the track 21 under the cap-lining mechanism 13 with the cover 31 on the track 21 removed for clarity of the drawing, the structure and relation of the first gate assembly 40 to the channel 30 can be seen clearly. The base 23 of the track 21 has a lining location 41, indicated by the dashed circle line, registered directly beneath the punch 33 and tamper 34 between the sidewalls 24 and 25. The lining location 41 is bounded by and defined within a circular perimeter 42. The first gate assembly 40 is located downstream from the lining location 41.

With continuing reference to FIG. 2, the first gate assembly 40 includes opposed pins 43 and 44 which are fixed at spaced intervals to a rotatable shaft 45 between opposed ends 50 and 51 of the shaft 45. The pins 43 and 44 are elongate, upstanding fingers extending radially away from the shaft 45. Pin 43 is proximate to the sidewall 24 and opposed pin 44 is proximate to the opposed sidewall 25. The ends 50 and 51 are pivotally mounted within bores 52 and 53 through blocks 54 and 55, which are carried in the base 23 beyond the sidewalls 24 and 25, respectively, of the track 21 so that the shaft 45 extends continuously across the track 21 and also across track 22. A cap 60 secured to the end 50 of the shaft prevents lateral movement of the shaft within the bores 52 and 53. Movement is also limited proximate to the other end 51, where the shaft 45 is in juxtaposition with the base 23. The shaft 45 is free to rotate within bores 52 and 53 along an axis of rotation extending along the length of the shaft 45. A cam 61 is fixed proximate to the end 51 of the shaft 45, and a reciprocating linear actuator 62 is coupled by a linkage 63 to the cam 61 so as to impart rotation to the shaft 45 in response to reciprocation of the linear actuator 62 along a direction indicated by the double-arrowed line B in FIG. 2. The linear actuator 62 may be a pneumatic piston, hydraulic piston, or other driving device capable of reciprocating movement.

The linear actuator 62 reciprocates between extended and retracted positions, which positions correspond to rotation of the shaft 45 between first and second positions. Rotation of the shaft 45 imparts corresponding rotational motion to the pins 43 and 44 within slots 64 formed through the base 23. In the first position of the shaft 45, shown in FIG. 3A, the pins 43 and 44 are in a raised position (only pin 43 is visible in this section view). In the raised position, the pins 43 and 44 extend from the base 23 of the track 21 through the slots 64 past the surface 32 upward toward the cover 31*a* distance P as shown in FIG. 3A. Distance P is approximately 0.125 inches. Pins 43 and 44 each have upstream- and inwardly-directed front faces 65, and in the raised positions of the pins 43 and 44, the front faces 65 are registered along a downstream portion of the perimeter 42 of the lining location 41, as best shown in FIG. 2. In the second position of the shaft 45, shown in FIG. 3B, the pins 43 and 44 are in a lowered position. In the lowered position, the pins 43 and 44, and the front faces 65 of the pins 43 and 44, are retracted below the surface 32 of base 23. The slots 64 are formed entirely through the base 23 and are elongate and slightly wider than the pins 43 and 44, so that the pins 43 and 44 may pass through the slots 64 during movement between the raised and lowered positions thereof. The first gate assembly 40 is constructed from materials which are light, rigid, and have low rotational inertia, such as aluminum or plastic, so that the first gate assembly 40 can be quickly and lightly rotated to move the pins 43 and 44 between the raised and lowered positions with a low application of torque and power.

Referring back to FIG. 2, a downstream or second gate assembly 70 temporarily interrupts and prevents the downstream movement of the caps 15 through the track 21 to hold a cap 15 downstream from the lining location 41 in a position for sensing. The base 23 of the track 21 has a sensing location 71, indicated by the dashed circle line in FIG. 2, located between the sidewalls 24 and 25. The sensing location 71 is bounded by and defined within a circular perimeter 72. Sensing location 70 is downstream from the lining location 41, and an upstream portion of the sensing location 71 overlaps slightly with a downstream portion of the lining location 41 between pins 43 and 44. The second gate assembly 70 is located downstream from the sensing location 71.

The second gate assembly 70 includes opposed pins 73 and 74 which are fixed at spaced intervals along a rotatable shaft 75 between opposed ends 80 and 81 of the shaft 75. The pins 73 and 74 are elongate, upstanding fingers extending radially away from the shaft 75. Pin 73 is proximate to the sidewall 24 and opposed pin 74 is proximate to the opposed sidewall 35. The ends 80 and 81 of the shaft 75 are pivotally mounted within bores 82 and 83 through blocks 84 and 85, which are carried in the base 23 beyond the sidewalls 24 and 25, respectively, of the track 21 and also across track 22. A cap 90 secured to the end 81 of the shaft 75 prevents lateral movement of the shaft 5 within the bores 82 and 83. Movement is also limited proximate to the other end 80, where the shaft 75 is in juxtaposition with the base 23. The shaft 75 is free to rotate within bores 82 and 83 along an axis of rotation extending along the length of the shaft 75. A cam 91 is fixed proximate to the end 80 of the shaft 75, and a reciprocating linear actuator 92 is coupled by a linkage 93 to the cam 91 so as to impart rotation to the shaft 75 in response to reciprocation of the linear actuator 92 along a direction indicated by the double-arrowed line C in FIG. 2. The linear actuator 92 may be a pneumatic piston, hydraulic piston, or other driving deice capable of reciprocating movement.

The linear actuator 92 reciprocates between extended and retracted positions, which positions correspond to rotation of the shaft 75 between first and second positions. Rotation of the shaft 75 imparts corresponding rotational motion to the pins 73 and 74 within slots 94 formed through base 23. In the first position of the shaft 75, shown in FIG. 3C, the pins 73 and 74 are in a raised position (only pin 73 is visible in this section view). In the raised position, the pins 73 and 74 extend from the base 23 of the track 21 through the slots 94 past the surface 32 upward toward the cover 31*a* distance P. Distance P is approximately 0.125 inches. Pins 73 and 74 each have upstream- and inwardly-directed front faces 95, and in the raised positions of the pins 73 and 74, the front faces 95 are registered along a downstream portion of the perimeter 72 of the sensing location 71, as best shown in FIG. 2. In the second position of the shaft 75, shown in FIG. 3D, the pins 73 and 74 are in a lowered position. In the lowered position, the pins 73 and 74, and the front faces 95 of the pins 73 and 74, are retracted below the surface 32 of the base 23. The slots 94 are formed entirely through the base 23 and are elongate and slightly wider than the pins 73 and 74, so that the pins 73 and 74 may pass through the slots 94 during movement between the raised and lowered positions thereof. The second gate assembly 70 is constructed from materials which are light, rigid, and have low rotational inertia, such as aluminum or plastic, so that the second gate assembly 70 can be quickly and lightly rotated to move the pins 73 and 74 between the raised and lowered positions with a low application of torque and power.

Referring now to FIG. 3A, cap-lining machine 10 includes a photoelectric sensor apparatus 100 mounted to the track assembly 13. The sensor apparatus 100 includes a photoelectric optic 101 and a corresponding reflector 102. Sensor apparatus 100 is located downstream from lining location 41 proximate to the sensing location 71. In the embodiment shown in FIG. 3A, the photoelectric optic 101 is mounted above the track 21 to a support 103 which is rigidly secured to cover 31, and the reflector 102 is inlaid within the base 23 flush with the surface 32, though the arrangement of optic 101 and the sensor 102 may be reversed. An aperture 104 is formed in the cover 31 between the optic 101 and the reflector 102 to allow the photoelectric sensor apparatus 100 to operate properly. Referring now to FIG. 2, reflector 102 is located within the sensing location 71 proximate to a downstream portion of the perimeter 72, and is located at a generally intermediate position between the pins 94 and 95. The reflector 102 has a top surface 105 even with the surface 32 of the track 21, and the top surface 105 has a reflective characteristic. Referring back to FIG. 3A, the optic 101 is capable of emitting a laser or beam of light toward the reflector 102 along the direction generally indicated by the dashed line E. That beam of light encounters top surface 105 and reflects back up along line E toward optic 101, where it is received by optic 101. When the beam is reflected back to optic 101, the sensor apparatus 100 registers that channel 30 of the track 21 above the sensing location 71 is clear. In other embodiments, the sensor 102 may be replaced with a programmable LED array, and the optic 101 may function in a receiving capacity to detect light from the LED.

Cover 31 also carries two air jets 110 and 111 to move the caps 15 downstream along the path through track 21 beneath cap-lining mechanism 13. Because air jets 110 and 11 are mounted to cover 31 and carried on cover 31 under the cap-lining mechanism 13, they cannot be seen in FIGS. 1 and 2. FIGS. 3A-3E show air jets 110 and 111, however. Air jets 110 and 111 are carried by the cover 31 above the sidewall 24 so as to not interfere with the operation of the cap-lining mechanism 13 or the photoelectric sensor apparatus 100. Referring to those figures, air jet 110 is an upstream air jet having a body 110*a* and a nozzle 110*b* directed downwardly through a hole 112 through the cover 31 toward the lining location 41. The air jet 110 also includes a hose (not shown) coupling the body 110*a* of the air jet 110 to a supply of pressurized air (not shown). Air jet 111 is a downstream air jet having a body 111*a* and a nozzle 111*b* directed downwardly through a hole 113 through the cover 31 toward the sensing location 71. A hose 111*c* couples the body 110*a* of the air jet 110 to a supply of pressurized air (not shown).

Figure 4A:
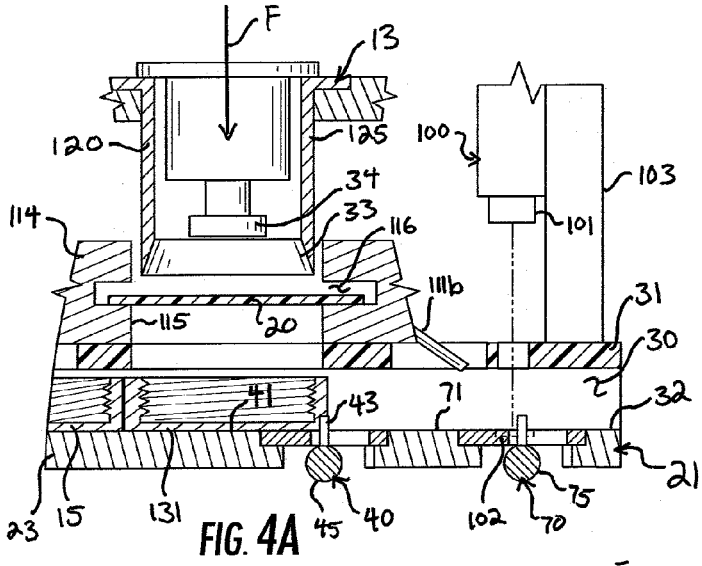
FIGS. 4A-4C are section views of the cap-lining mechanism and the track assembly taken along the line 4-4 in FIG. 1, showing a sequence of operational steps of the cap-lining mechanism of FIG. 1.
Figure 4B:
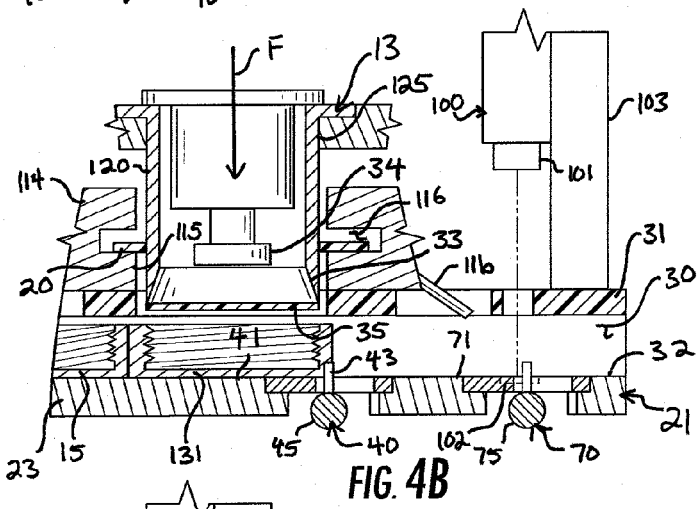
Figure 4C:
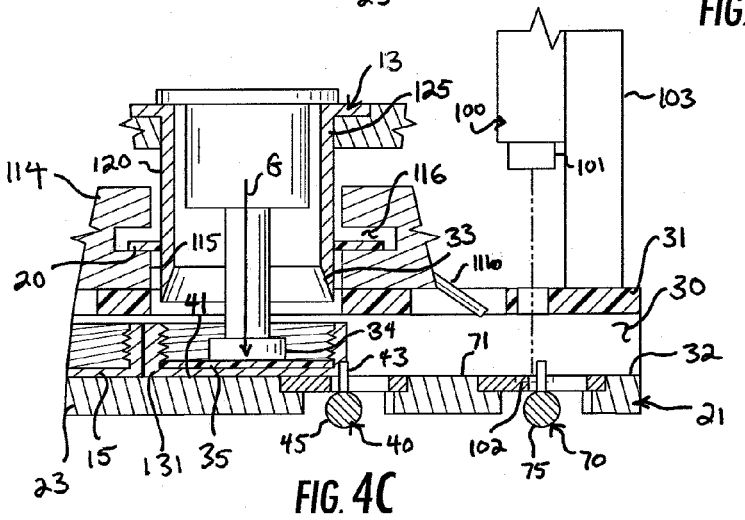

Turning now to the cap-lining mechanism 13 of the cap-lining machine 10 shown in FIG. 1 and FIGS. 4A-4C, the cap-lining mechanism 13 includes a heavy, rugged, metal punch block 114 which carries a rugged metal die 115, a slot 116 through which the web of liner paper 20 moves, and punch assemblies 120 and 130 over the tracks 21 and 22. The punch block 114 is located above the track assembly 12 and is rigidly secured to the table 11. The punch assemblies 120 and 130 are identical in every respect to each other except in location and as described herein, and as such, the discussion will refer to the structural and functional aspects of only the punch assembly denoted with the reference character 120, located over track 21, with the understanding that the discussion applies equally to the structural and functional aspects of punch assembly 130, located over track 22. With reference to FIG. 1, the punch assembly 120 is pivotally coupled to a rocker arm 121 which is fixed to a shaft 122 mounted for rotation to the punch block 114. In the embodiment shown in FIG. 1, the shaft 122 is driven by a crank arm 123 coupled to an actuator 124 that reciprocates along a direction in and out of the page. Movement of the actuator 124 along a direction out of the page in FIG. 1 imparts rotation to the shaft 122 and causes the punch assembly 120 to extend downwardly into the die 115 along a direction generally indicted by line F in FIGS. 4A and 4B. With reference to FIG. 4A, the punch assembly 120 includes the punch 33, a cylindrical sleeve 125 extending from and encircling the punch 33, and the tamper 34 encircled by the sleeve 125, so that rotation of the shaft imparts movement on both the punch 22 and the tamper 34 together. The tamper 34 is coupled to a piston or mechanical reciprocating device and is carried within the punch assembly 120 for reciprocation independent of the punch 33 along a direction generally indicated by the line G in FIG. 4C. Both the punch 3 and the tamper 34 are heavy machined pieces of metal having material characteristics of high density, ruggedness, and durability, as each is subjected to repeated and continuous wear. Both the punch 33 and the tamper 34 are contained within the sleeve 125 and the punch block 114 so as to contain potentially dangerous parts away from a user.

Operation of the cap-lining machine 10 according to the principles of the invention will now be discussed with reference to FIGS. 3A-3E and FIGS. 4A-4C, which are section views through the track assembly 12 illustrating operation of the track assembly 12 and the cap-lining mechanism 13, respectively. With reference first to FIG. 3A, and as described above, the caps 15 are provided, open bottoms 15*b* oriented up, to the track 21 by a gravity feed or a light-action belt conveyor onto the track 21 from the supply bin (not shown) along the direction indicated by line A. The caps 15 move in sliding contact on the surface 32 which has a low coefficient of friction, so that a low amount of downstream force will move the caps 15 downstream. FIG. 3A illustrates the track assembly 12 in an initial, starting condition in which the pins 43 and 44 of the first gate assembly 40 are in the raised positions thereof at the lining location 41, and the pins 73 and 74 of the second gate assembly 70 are in the raised positions thereof at the sensing location 71. In this condition, the pins 43 and 44, and the pins 73 and 74, are arranged in interfering positions to the downstream movement of the caps 15 in which each opposes or prevents the movement of the caps 15 from the upstream end beyond the lining location 41 and the sensing location 71, respectively. The caps 15 are thus allowed to slide downstream toward the lining location 41 until a first cap 131 encounters the pins 43 and 44 of the first gate assembly 40. For purposes of clarity in the ensuing discussion of the operation of the cap-lining machine 10, the cap 15 which is furthest downstream in the line of caps 15 shown in FIG. 3A will given the reference number 131 and referred to as the first cap 131. Reference will also be made to a second cap 132 which is the cap 15 just upstream from the first cap 131.

When the first cap 131 encounters the pins 43 and 44, the pins 43 and 44 prevent further downstream movement of the first cap 131 and hold the first cap 131 at the lining location 41, thus also preventing the line of upstream caps 15 from moving further downstream. In this condition, the outer sidewall 15*a* of the first cap 131 is registered with the perimeter 42 of the lining location 41 and the downstream portion of the outer sidewall 15*a* is received against the front faces 65 of the pins 43 and 44. Moreover, the upstream portion of the outer sidewall 15*a* is in contact with the second cap 132 The second cap 132, with the force of the upstream caps 15 bearing the second cap 132 forward toward the lining location 41, presses from a contact point 133 on the upstream portion of the outer sidewall 15*a* of the first cap 131. The first cap 131 is thus located between the front face 65 of the pin 43, the front face 65 of the pin 44, and the contact point 133 of the second cap 132, which three points of contact are spaced approximately 120 degrees apart from the others about the sidewall 15*a*, and cooperate to position, register, and center the first cap 131 at the lining location 41 without applying a bias or squeezing the first cap 131.

The first cap 131 has a diameter D which is slightly less than the width W of the channel 30 in the track 21, and as seen in FIG. 2 the lining location 41 extends from just short of the sidewall 24 to just short of the sidewall 25, so that there is a gap on each side of the first cap 131 between the outer sidewall 15*a* of the first cap 131 and the sidewalls 24 and 25 of the channel 30. While the tight clearance between the diameter D of the first cap 131 and the channel 30 prevents the first cap 131 from moving laterally as it is sliding downstream toward the lining location 41, it is the cooperation of the three points of contact between the pins 43 and 44 and the second cap 132 that positions the first cap 131 at the lining location 41. The pin 43 prevents the first cap 131 from moving laterally out of the lining location 41 toward the sidewall 24, the pin 44 prevents the first cap 131 from moving laterally out of the lining location 41 toward the sidewall 25, and the second cap 132 prevents the first cap 131 from moving upstream out of the lining location 41.

The raised position of the pins 43 and 44 constitute an interfering position in the downstream movement of the caps 15. The clearance between the pins 43 and 44 and the cover 31 in the channel 30 is not large enough to allow the first cap 131 to move downstream out of the lining location 41. The pins 43 and 44 each have a height P, which is greater than the difference between the height S of the channel 30 between the cover 31 and the track 21 and the height H of the caps. For instance, in the embodiment shown in FIG. 3A, the pins 43 and 44 each extend into the channel 30 a distance P of approximately 0.125 inches. The channel 30 has a height S equal to 0.500 inches between the cover 31 and the track 21, thus leaving a gap of approximately 0.375 inches between the top of the pins 43 and 44 and the cover 31. However, the first cap 131 has a height S of approximately 0.450 inches, which is too great to fit through the gap. Thus, the pins 43 and 44 both prevent the first cap 131 from moving downstream out of the lining location 41. It will be understood that the first gate assembly 40 could be carried above the track 21 and would still operate to move the pins 43 and 44 between a raised, interfering position and a lowered position allowing the downstream movement of the caps 15.

With the first cap 131 held in this manner at the lining location 41, the first gate assembly 40 cooperates with the caps 15 to define a lining configuration in which the first cap 131 is prepared for lining directly below the cap-lining mechanism 13, and the cap-lining mechanism 13 is ready to be activated. A computer or control panel coupled to the cap-lining machine 10 controls movement of the cap-lining mechanism 13 and synchronizes that movement with the movement of the first and second gate assemblies 40 and 70, with the operation of the sensor apparatus 100, and with the operation of the air jets 110 and 111. When the cap-lining machine is in the initial, start position, as shown in FIG. 4A, with the caps 15 loaded onto the track 21, the first cap 131 located at the lining location 41, and the punch assembly 120 in a retracted position, the cap-lining mechanism is activated. The punch assembly 120 descends into the die 115 along the direction indicated by line F in FIG. 4A. The punch 33 encounters the web of liner paper 20 and shears a liner insert 35 from the liner paper 20 as it continues to descend along the direction indicated by line F in FIG. 4B. The punch assembly 120 descends to just above the first cap 131 and the tamper 34 then descends along the direction indicated by line G in FIG. 4C, until the tamper 34 applies the liner insert 35 into the first cap 131, lining the liner insert 35 in the first cap 131. The tamper 34 and punch assembly 120 are then withdrawn upwards to their original starting positions. Although the movement of the punch assembly 130 is described here as a sequence of steps, it should be understood that it is accomplished in one smooth, continuous motion, during which the pins 43 and 44 and the second cap 132 continue to maintain the first cap 131 in position at the lining location 41. The activation of the cap-lining mechanism 13 in this manner repeats in cycles each time a lined cap 15 is successfully ejected from the lining location 41 and a fresh cap 15 is loaded into the lining location 41, with each cycle taking less than a second.

Figure 3B:
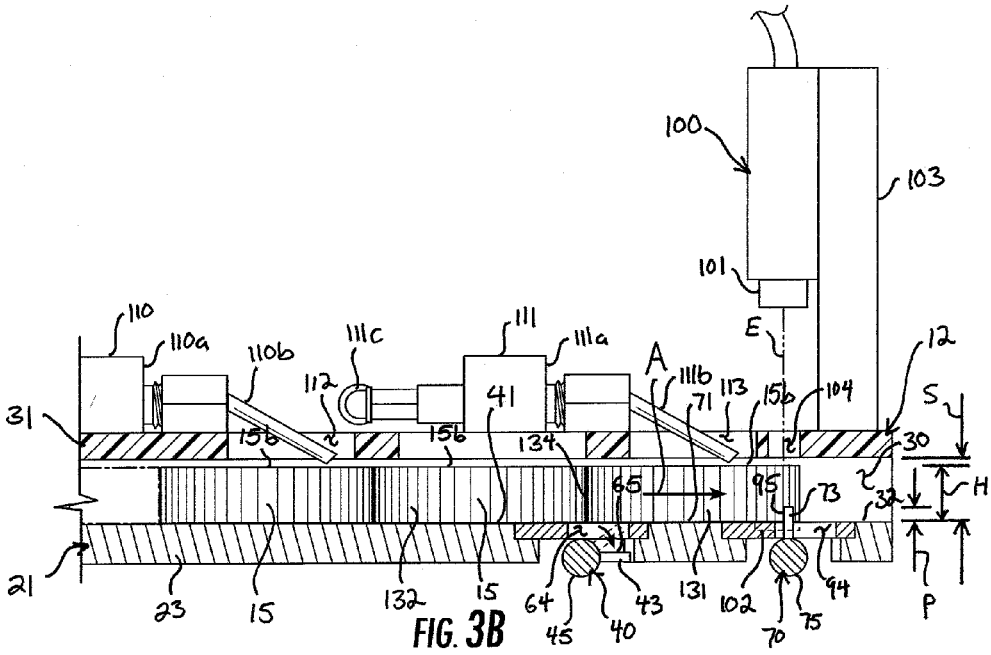

With the liner insert 35 successfully applied into the first cap 131, the first cap 131 may be moved from the lining location 41 to the sensing location 71. With reference to FIG. 3B, which illustrates this next step, the first gate assembly 70 is quickly and lightly moved so that the pins 43 and 44 are lowered below the surface 32 of the track 21, thereby allowing the caps 15 to move downstream along a direction indicated by arrowed line A in FIG. 3B toward the sensing location 71. The first cap 131 moves downstream as the upstream caps 15 move downstream under the force of the gravity feed. To accelerate and ensure fast, smooth, responsive, and non-deforming movement of the first cap 131 downstream out of the lining location 41, air jet 110 is activated. A brief pressurized stream of air exits nozzle 110*b* and is directed through the hole 112 in the cover 31 downstream, toward the lining location 41. The stream of air causes the first cap 131 to slide downstream along line A in FIG. 3B, ejecting the first cap 131 from the lining location 41. With the second gate assembly 70 raised, the caps 15 move downstream until the first cap 131 encounters the raised pins 73 and 74 of the second gate assembly 70.

With continuing reference to FIG. 3B, when the first cap 131 encounters the pins 73 and 74, the pins 73 and 74 prevent further downstream movement of the first cap 131 and hold the first cap 131 at the sensing location 71, thus also preventing the line of upstream caps 15 from moving further downstream. In this condition, the outer sidewall 15*a* of the first cap 131 is registered with the perimeter 72 of the sensing location 71 and the downstream portion of the outer sidewall 15*a* is received against the front faces 95 of the pins 73 and 74. Moreover, the upstream portion of the outer sidewall 15*a* of the first cap 131 is in contact with the second cap 132. The second cap 132, with the force of the upstream caps 15 bearing the second cap 132 forward toward the sensing location 71, presses from a contact point 134 on the upstream portion of the outer sidewall 15*a* of the first cap 131. The first cap 131 is thus located between the front face 95 of the pin 73, the front face 95 of the pin 74, and the contact point 134 of the second cap 132, which three points of contact are each spaced approximately 120 degrees apart from the others about the sidewall 15*a*, and cooperate to position, register, and center the first cap 131 at the sensing location 41 without applying a bias or squeezing the first cap 131. The cooperation of these three points of contact act to hold and locate the first cap 131 at the sensing location 71. The pin 73 prevents the first cap 131 from moving laterally out of the sensing location 71 toward the sidewall 24, the pin 74 prevents the first cap 131 from moving laterally out of the sensing location 71 toward the sidewall 25, and the second cap 132 prevents the first cap 131 from moving upstream out of the sensing location 71.

The raised position of the pins 73 and 74 constitute an interfering position in the downstream movement of the caps 15. The clearance between the pins 73 and 74 and the cover 31 in the channel 30 is not large enough to allow the first cap 131 to move downstream out of the sensing location 71. The pins 73 and 74 each have a height P, which is greater than the difference between the height S of the channel 30 between the cover 31 and the track 21 and the height H of the caps 15. For instance, in the embodiment shown in FIG. 3B, the pins 73 and 74 each extend into the channel 30 a distance P of approximately 0.125 inches. The channel 30 has a height S equal to 0.500 inches between the cover 31 and the track 21, thus leaving a gap of approximately 0.375 inches between the top of the pins 73 and 74 and the cover 31. However, the first cap 131 has a height S of approximately 0.450 inches, which is too great to fit through the gap. Thus, the pins 73 and 74 both prevent the first cap 131 from moving downstream out of the sensing location 71. It will be understood that the second gate assembly 70 could be carried above the track 21 and would still operate to move the pins 73 and 74 between a raised, interfering position and a lowered position allowing the downstream movement of the caps 15.

With the first cap 131 held in this manner at the sensing location 71, the second gate assembly 70 cooperates with the caps 15 to define a sensing configuration in which the first cap 131 is prepared to be sensed by the sensor apparatus 100 and the sensor apparatus 100 is ready to be activated. The sensing configuration is different from the lining configuration. Indeed, the second cap 132, resting in contact with the downstream portion of its outer sidewall 15*a* against the upstream portion of the outer sidewall 15*a* of the first cap 131, is slightly upstream from the lining location 41 in a ready location, and is not yet in position to be lined by the cap-lining mechanism 13. The ready location of the second cap 132 corresponds to the dashed circular line marked with the reference character 135 in FIG. 2. Returning to FIG. 3B, after performing an activation cycle of the cap-lining mechanism 13 and moving the pins 43 and 44 of the first gate assembly 40 into the lowered position, the next step in the sequence of logic in the computer is to detect the presence of the first cap 131 at the sensing location. Detection of the first cap 131 at the sensing location 71 is consistent with the first cap 131 having moved out of the lining location 41 after being lined with the liner insert 35.

With continuing reference to FIG. 3B, optic 101 emits a laser or beam of light toward the reflector 102 along the direction generally indicated by the dashed line E. With the first cap 131 held at the sensing location, directly over the sensor 102, the laser does not encounter or reflect off the reflective surface 105 back toward the optic 101. Instead, the laser is absorbed in the first cap 131, and the computer coupled to the sensor apparatus 100 detects the presence of the first cap 131 at the sensing location 71. If, on the other hand, had there been no cap 15 at the sensing location 71, the laser would have reflected off the reflective surface 105 and back into the optic 101, and the computer would not have detected the presence of a cap 15 at the sensing location 71.

Figure 3C:
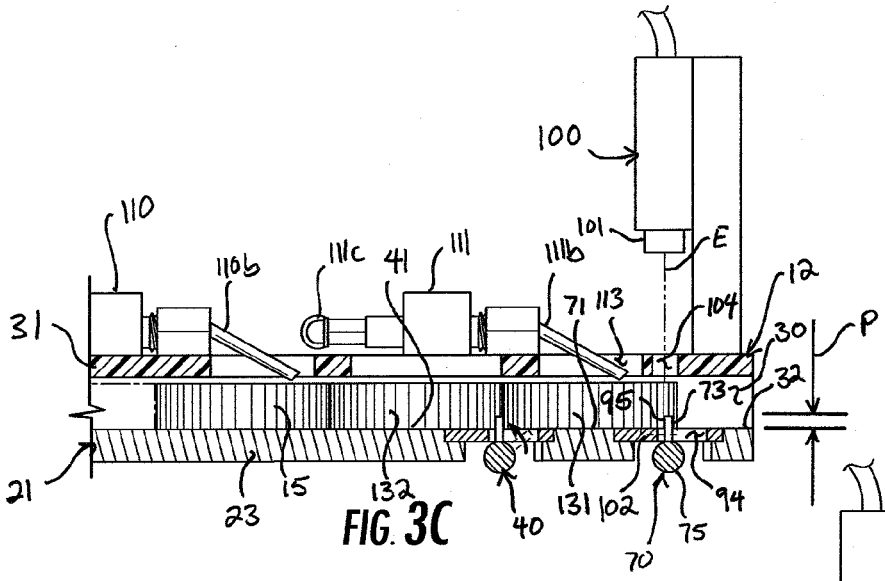

Upon detection of the first cap 131 at the sensing location 71, the next step in the process is ejecting the first cap 131 from the sensing location 71. To eject the first cap 131 from the sensing location 71, the pins 43 and 44 of the first gate assembly are quickly and lightly moved back into the raised positions, as shown in FIG. 3C. This causes no disturbance in the line of caps 15 because the pins 43 and 44, in their raised positions, are registered along the downstream side of the perimeter 42 of the lining location 41, and the second cap 132 is just slightly upstream from the lining location 41 at the ready location 135 so that the pins 43 and 44 do not contact the second cap 132. Once the pins 43 and 44 are moved into the raised positions, the first cap 131 can be ejected from the sensing location 71 by quickly and lightly lowering the second gate assembly 70, as seen in FIG. 3D.

Figure 3D:
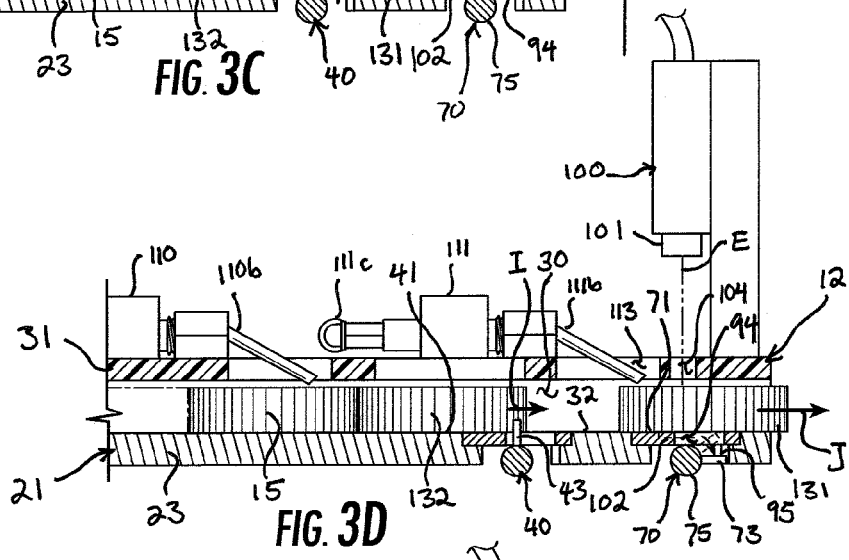

When the pins 73 an 74 of the second gate assembly 70 are lowered below the surface 32 of the track 21, the first cap 131 moves downstream along the line I in FIG. 3D only slightly as the upstream caps 15 move downstream slightly under the force of the gravity feed until the second cap 132 moves from the ready location 135 to the lining location 41 where it encounters and is prevented from moving forward by the raised pins 43 and 44 of the first gate assembly 40, as shown in FIG. 3D. The second cap 132 is now at the lining location 41 in contact with the pins 43 and 44, and holds the upstream caps 15 from moving forward. The computer then activates the air jet 111, sending a brief pressurized stream of air through nozzle 111*b* directed through the hole 113 in the cover 31 downstream, toward the sensing location 71. The stream of air causes the first cap 131 to slide downstream along line J in FIG. 3D, ejecting the first cap 131 from the first cap 131 from the sensing location 71.

Figure 3E:
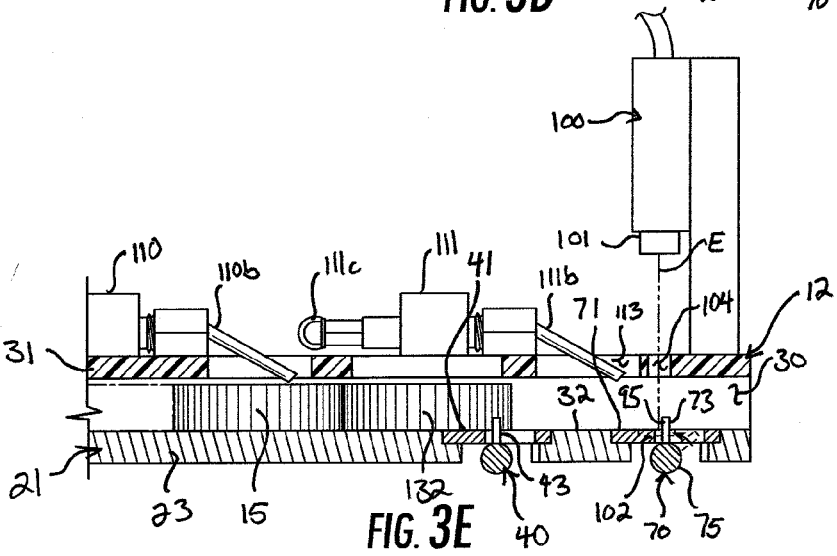

After the first cap 131 is ejected from the sensing location 131, the pins 73 and 74 of the second gate assembly 70 quickly and lightly move back into the raised positions thereof as shown in FIG. 3E, in which the first gate assembly 40 and the caps 15 are arranged in the lining configuration as in FIG. 3A, with the second cap 132 in FIG. 3E now in the place of the first cap 131 in FIG. 3A. Operation of the cap-lining mechanism 13 may continues cyclically from the lining configuration with the steps described above in reference to FIGS. 3A-3E. In this manner, caps 15 are repeatedly positioned at the lining location 41, lined with a liner insert 41, moved to the sensing location 71, detected at the sensing location 71, and ejected from the sensing location 71 in response to detection at the sensing location 71. Fresh, unlined caps 15 are fed into and positioned at the lining location 41 when a cap 15 is detected and ejected from the sensing location 71.

The present invention is described above with reference to a preferred embodiment. However, those skilled in the art will recognize that changes and modifications may be made in the described embodiment without departing from the nature and scope of the present invention. Various further changes and modifications to the embodiment herein chosen for purposes of illustration will readily occur to those skilled in the art. To the extent that such modifications and variations do not depart from the spirit of the invention, they are intended to be included within the scope thereof.

Having fully described the invention in such clear and concise terms as to enable those skilled in the art to understand and practice the same, the invention claimed is:

The invention claimed is:

1. An assembly for moving caps through a cap-lining machine, the assembly comprising:

a track for the downstream movement of the caps from an upstream end of the track to an opposed downstream end of the track;

a cap-lining location formed in the track between the upstream and downstream ends;

a first gate mounted downstream from the cap-lining location for movement between a first position preventing the downstream movement of the caps past the cap-lining location and a second position allowing the downstream movement of the caps past the cap-lining location;

a sensing location formed in the track downstream from the cap-lining location;

a second gate mounted downstream from the sensing location for movement between a first position preventing the downstream movement of the caps past the sensing location and a second position allowing the downstream movement of the caps past the sensing location;

a sensor for sensing the arrival of one of the caps at the sensing location; wherein the first gate moves to the first position in response to the sensor sensing the arrival of the one of the caps at the sensing location; and the second gate moves to the second position in response to the first gate moving to the first position in response to the sensor sensing the arrival of the one of the caps at the sensing location.

2. The assembly of claim 1, wherein the first gate cooperates with the caps to position another of the caps at the cap-lining location in preparation for lining.

3. The assembly of claim 1, wherein the cap-lining location is registered with a punch mounted for reciprocal movement toward and away from the cap-lining location.

4. The assembly of claim 3, wherein the cap-lining location is fixed with respect to the punch.

5. The assembly of claim 1, wherein:

the first gate includes pins;

in the first position of the first gate, the pins extend into the track in an interfering position to the downstream movement of the caps; and in the second position of the first gate, the pins are refracted away from the track.

6. The assembly of claim 5, wherein:

the pins are opposed to each other; and each of the pins is proximate to an opposed side of the track.

7. The assembly of claim 5, wherein in the first position of the first gate, the pins of the first gate cooperate with the caps to position another of the caps at the cap-lining location in preparation for lining.

8. An assembly for moving caps through a cap-lining machine, the assembly comprising:

a track for the downstream movement of the caps from an upstream end of the track to an opposed downstream end of the track;

a cap-lining location formed in the track between the upstream and downstream ends; and means for allowing the downstream movement of one of the caps to the cap-lining location in response to ejection of another of the caps from the cap-lining location.

9. The assembly of claim 8, wherein the means for allowing the downstream movement of one of the caps comprises:

a first gate mounted proximate to the cap-lining location for movement between a first position preventing the downstream movement of the caps and a second position allowing the downstream movement of the caps;

a second gate mounted downstream from the first gate for movement between a first position preventing the downstream movement of the caps and a second position allowing the downstream movement of the caps;

a sensing location formed in the track between the first and second gates;

a sensor for sensing the arrival of the other of the caps at the sensing location; wherein the first gate moves to the first position in response to the sensor sensing the arrival of the other of the caps at the sensing location; and the second gate moves to the second position in response to the first gate moving to the first position in response to the sensor sensing the arrival of the other of the caps at the sensing location.

10. The assembly of claim 9, wherein the cap-lining location is registered with a punch mounted for reciprocal movement toward and away from the cap-lining location.

11. The assembly of claim 10, wherein the cap-lining location is fixed with respect to the punch.

12. The assembly of claim 9, wherein one of the first and second gates cooperates with the caps to position the one of the caps at the cap-lining location in preparation for lining.

13. The assembly of claim 12, wherein:

the first gate is downstream from the cap-lining location; and the first gate cooperates with the caps to hold the one of the caps at the cap-lining location in preparation for lining.

14. The assembly of claim 9, wherein:

the first gate includes opposed pins each proximate to an opposed side of the track; and in the first position of the first gate, the pins of the first gate extend into the track in an interfering position to prevent downstream movement of the caps, and cooperate with the caps to position the one of the caps at the cap-lining location in preparation for lining.

15. A method of lining caps, comprising:

providing an assembly for moving the caps through a cap-lining machine, the assembly comprising a track for the downstream movement of the caps from an upstream end of the track to a cap-lining location at an opposed downstream end of the track, and first and second gates each mounted downstream from the cap-lining location for movement between first and second positions;

providing caps to the track;

moving each of the first and second gates to the first position;

allowing the caps to move downstream toward the cap-lining location until a first cap encounters the first gate, the first gate cooperating with the caps to define a cap-lining configuration;

activating the cap-lining machine to line the first cap;

allowing the caps to move downstream toward a sensing location until the first cap encounters the second gate, the second gate cooperating with the caps to define a sensing configuration;

sensing the first cap at the sensing location; and ejecting the first cap from the sensing location.

16. The method of claim 15, wherein in the cap-lining configuration, the first gate and the caps cooperate to position the first cap at the cap-lining location in preparation for lining.

17. The method of claim 15, wherein in the sensing configuration, the second gate and the caps cooperate to position the first cap at the sensing location in preparation for sensing.

18. The method of claim 15, wherein the step of allowing the caps to move downstream toward the sensing location includes moving the first gate into the second position.

19. The method of claim 15, wherein the step of ejecting includes:

moving the first gate to the first position in response to sensing the first cap at the sensing location;

moving the second gate to the second position in response to moving the first gate to the first position; and moving the first cap from the sensing location in response to moving the second gate to the second position.

20. The method of claim 19, wherein the step of moving the first cap from the sensing location further includes allowing the caps to move downstream toward the cap-lining location until the second cap encounters the first gate, the first gate cooperating with the caps to position the second cap at the cap-lining location in preparation for lining.

* * * * *